United States Patent [19]

James

[11] 4,327,908

[45] May 4, 1982

[54] WEIGHT LIFTING BAR APPARATUS FOR EXERCISING BICEPS

[76] Inventor: Jeffrey S. James, 11248 N. Biltmore Dr., Apt. 208, Phoenix, Ariz. 85029

[21] Appl. No.: 74,247

[22] Filed: Sep. 10, 1979

[51] Int. Cl.[3] ..... A63B 21/12

[52] U.S. Cl. ..... 272/119; 272/143; 272/122

[58] Field of Search ..... 272/119, 117, 123, 143, 272/144, 122, 134

[56] References Cited

U.S. PATENT DOCUMENTS 2,617,650 11/1952 Landis ..... 272/122

4,109,908 8/1978 Pugh et al. ..... 272/119

*Primary Examiner*—Richard C. Pinkham

*Assistant Examiner*—William R. Browne

*Attorney, Agent, or Firm*—H. Gordon Shields

[57] ABSTRACT

Weight lifting apparatus includes a bar for supporting weights on the user's forearms and a bar for grasping the apparatus by the user's hands spaced apart from a bar adjacent the bar which supports weights. The apparatus has a support frame secured to the primary bar which rests on the forearms of a user. A grasping member extends from the primary bar on the opposite side of the primary bar.

12 Claims, 11 Drawing Figures

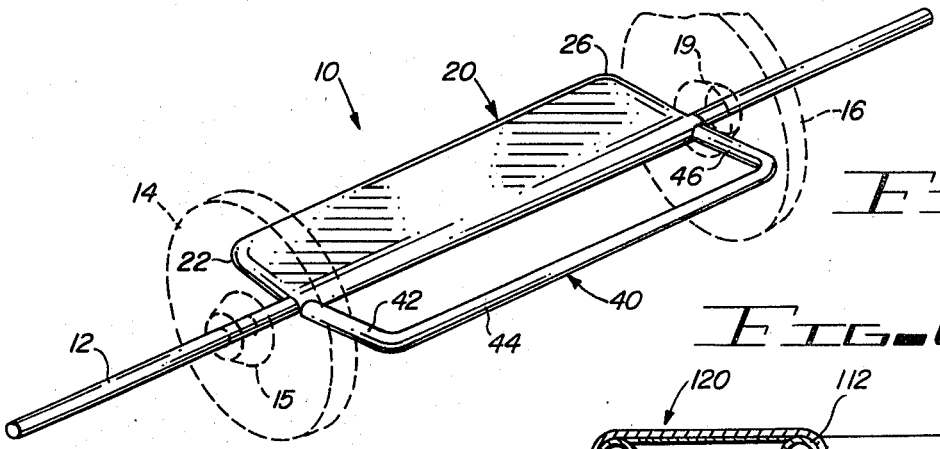
FIG. 1
FIG. 6
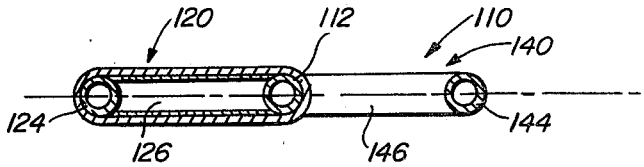
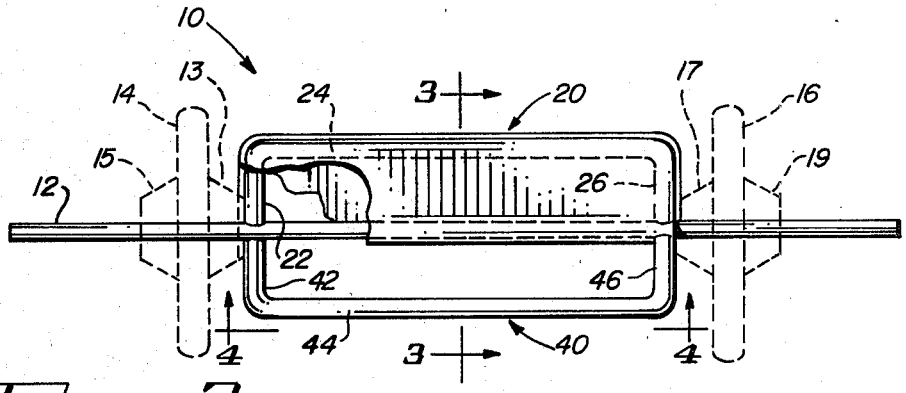
FIG. 2
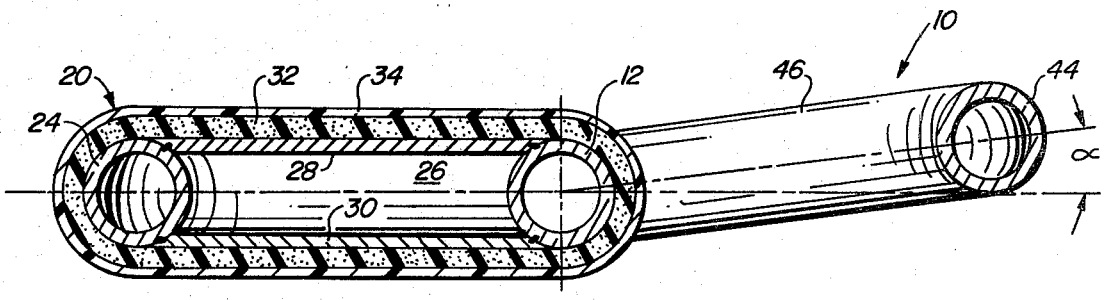
FIG. 3
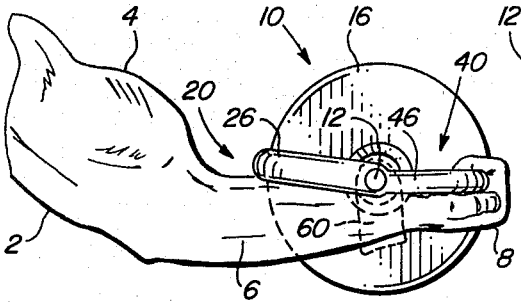
FIG. 5
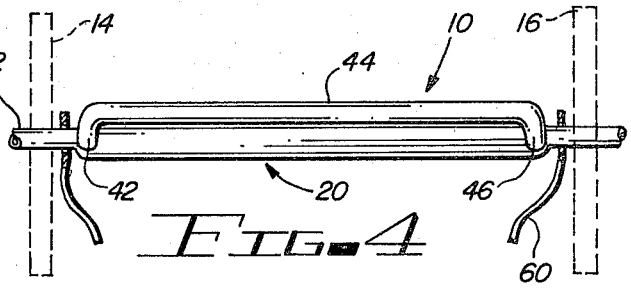
FIG. 4

WEIGHT LIFTING BAR APPARATUS FOR EXERCISING BICEPS

BACKGROUND OF THE INVENTION

1. Field of the Invention

This invention relates to weight lifting apparatus and, more particularly, to weight lifting apparatus for exercising the bicep muscles.

2. Description of the Prior Art

In addition to elaborate weight lifting equipment comprising or including a plurality of pulleys, springs, levers, and various types of mechanical linkages, the traditional apparatus for a user (weight lifter) has been, and still remains, a single bar or pipe to which weights are secured. The weights are spaced apart and are held in place by collars secured to the rod. The weights are evenly distributed for proper balance. The user grasps the rod or pipe between the weights and performs his exercises.

While such a relatively simple apparatus is advantageous and desirable for many applications, such apparatus is not effective to exercise the biceps for maximum efficiency in developing the biceps. The primary reason is that with such a single bar, a substantial amount of weight is borne by the muscles in a person's forearm. The burden of the weight is accordingly borne by both the biceps and the forearm muscles, and the user is unable to isolate the biceps from the forearm muscles. Since the forearm muscles will become fatigued before the biceps, the biceps will not be worked or exercised to their fullest.

To compensate for the sharing of the weights between the biceps and the muscles of the forearm, the traditional straight bar has been modified somewhat by providing offset hand holds on the bar, the intent being to change the orientation of the hand, wrist, and forearm of the user in doing weight lifting exercises designed for the biceps, such as curls. Such modifications of the traditional straight bar has been generally unsuccessful for the intended purpose for the primary reason that the muscles of the forearm still share the lifting burden with the biceps.

Another modification of the traditional, straight bar is shown in U.S. Pat. No. 3,384,370, in which a pair of rings is secured to the bar, spaced apart from each other, and both rings are spaced apart inwardly from the weights, or from the ends of the bar at which the weights are disposed. Within the rings are rotatable handle grips. As the user grasps the handles, and applies a force to lift the bar and weights, the handles rotate within the rings in response to any torque applied to the handles by the user. However, the U.S. Pat. No. 3,384,370 apparatus does not relieve the forearms from sharing the lifting burden with the biceps when a user performs curl, or other lifting exercises designed for the biceps.

SUMMARY OF THE INVENTION

The invention described and claimed herein comprises a bar secured to a frame, with the bar supporting weights and the frame including a member adapted for grasping by the hands of a user and a portion of the frame designed to rest on the forearms of the user to relieve the muscles of the forearm from the shared burden of lifting the weight as the user exercises his biceps.

Among the objects of the invention are the following:

To provide new and useful weight lifting apparatus;

To provide new and useful weight lifting apparatus for exercising the biceps muscles;

To provide new and useful apparatus for isolating the biceps muscles from the forearm muscles;

To provide new and useful exercise apparatus for maximum exercising of the biceps muscles and minimum exercising of the forearm muscles;

To provide new and useful exercise apparatus having a frame secured to a weight carrying bar; and To provide new and useful apparatus having a hand grippable member offset from the longitudinal axis of a weight holding bar.

BRIEF DESCRIPTION OF THE DRAWING

FIG. 1 comprises a perspective view of the apparatus of the present invention.

FIG. 2 is a top view of the apparatus of FIG. 1.

FIG. 3 comprises a partial section of the apparatus of FIG. 2 taken generally along line 3—3 of FIG. 2.

FIG. 4 comprises a view of the apparatus of FIG. 2 taken generally along line 4—4 of FIG. 2.

FIG. 5 comprises an end view of the apparatus of the present invention illustrating its employment by a user.

FIG. 6 comprises a view in partial section of an alternate embodiment of the apparatus of FIGS. 1–5.

DESCRIPTION OF THE PREFERRED EMBODIMENT

Figure 7:
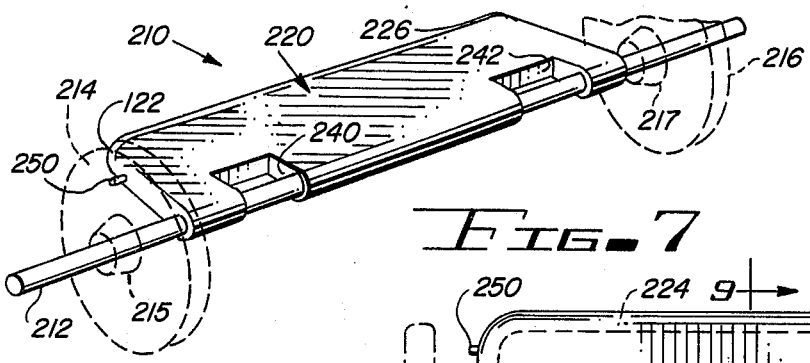
FIG. 7 is a perspective view of an alternative embodiment of the apparatus of FIGS. 1–6.

FIG. 1 comprises a perspective view of the apparatus 10 which includes a primary bar 12 with a pair of weights 14 and 16 disposed on the primary bar 12, and shown in phantom (dotted line). The weights are held in place by collars 13, 15, 17, 19 arranged in pairs. Secured directly to the primary bar 12 is a support frame 20 and a holding frame 40.

FIG. 2 is a top view of the weight lifting apparatus 10 of FIG. 1, with a portion of the support frame 20 broken away to show various elements associated or included therewith. FIG. 3 is a view in partial section of the weight lifting apparatus 10, taken generally along line 3—3 of FIG. 2. FIG. 4 is a view of the weight lifting apparatus 10 of FIG. 2 taken generally along line 4—4 of FIG. 2. FIG. 5 is a side view, in partial section, of the weight lifting apparatus 10, illustrating its use of employment by a user. For the following description of the weight lifting apparatus 10, attention will be made to FIGS. 1, 2, 3, 4, and 5.

The primary bar 12 of the weight lifting appartus 10 is preferably a steel bar, similar to the steel bars employed as weight lifting bars in the prior art. The bar is preferably about forty-eight inches long, and it may typically be fabricated from steel stock about one inch or so in diameter. While the term "bar" is used herein, a steel pipe or tube may be used, as desired.

Centrally disposed with respect to the primary bar 12 are a pair of frames secured to the bar. The support frame 20 is secured to and extends outwardly from the bar 12 in one direction, and the holding frame 40 is secured to the bar and extends a substantial distance outwardly therefrom generally oppositely from the support frame 20. The frames 20 and 40 are substantially similar to each other in dimension, and they are both preferably made of about one inch tubing, generally about the same overall or outside diameter as the bar or tube 12. It will be noted, particularly from FIGS. 3, 4, and 5, that a plane extending through the primary bar 12 and the support frame 20 will not pass through the holding frame 40. Similarly, a plane passing through the primary bar 12 and the holding frame 40 will not pass through the support frame 20. Rather, there is an angle alpha, best shown in FIG. 3, between the planes passing through the center of the respective support and holding frames and through the center of the primary bar or tube 12. The reason for the angular difference may be seen from FIG. 5, in which the support frame 20 is disposed on a forearm 6 of a user's arm 2. The angle alpha is an acute angle, and the angle between the support frame and the holding frame is accordingly less than one hundred eighty degrees.

The angular difference between the two planes results in an offset distance or raise of about one-half inch between the bars 24 and 44. This allows the weight of the apparatus, through the support frame 20, to be placed on the forearm 6, above the user's wrist, when the apparatus 10 is used by people with large forearms. However, as shown in FIG. 6, such offset is not mandatory.

The support frame 20 includes a pair of arms 22 and 26 spaced apart from each other in substantially parallel alignment, and secured to the primary bar or tube 12. Between the distal ends of the arms 22 and 26, remote from the primary bar 12, is a leg 24. Preferably, the arms and leg of the support frame 20 are made of a single piece of one inch tubing, simply bent with ninety degree angles, as required, and with the ends of the support frame being secured, as by welding, to the primary bar 12.

Extending outwardly from the bar 12 on the opposite side of the bar from the support frame 20 is a holding frame 40. The holding frame 40 also includes a pair of arms 42 and 46 which is appropriately secured, as by welding, to the bar 12. The holding frame 40 is, like the support frame 20, preferably made of a single length of tubing, bent into an elongated U configuration, and comprising a pair of arms 42 and 46, with a leg 44 extending therebetween. The arms 42 and 46 are substantially parallel to each other, and are disposed at substantially a right angle to the bar 12, and generally aligned with the arms 22 and 26 of the support frame 20. The arms of the respective frames are preferably disposed about twenty or twenty-one inches apart, or about ten inches from the center of the bar 12. The spacing between the leg 24 and the bar 12 is about three inches, as is the spacing between the leg 44 and the arm 12.

As best shown in FIG. 3, the support frame 20 is padded for the covenience of the user. A pair of supports, such as wood or sheet metal, are appropriately secured to the primary bar 12 and also to the leg 24. The support sheets are best shown in FIG. 3. They include an upper support sheet 28 and a lower support sheet 30. The purpose of the support sheets 28 and 30, which preferably are sheet metal welded to the arms and legs of the support frame, and also to the primary bar 12, is to support an outer layer of padding 32, which may be foam rubber, for comfort to the user of the apparatus. An outer cover 34, which may be a layer of vinyl, is in turn disposed about the foam layer 32, the support sheets 28 and 30, the bar 12, leg 24, and the arms 22 and 26.

The weight lifting apparatus 10 is preferably used with a bench, such as a preacher or scott cure bench, but also may be used with the user (weight lifter) in a standing position. In such case, a strap 60, best shown in FIGS. 4 and 5, is used to hold the apparatus to a user'-arm (see FIG. 5). The strap 60 is preferably made of a relatively wide material that is also generally flexible so as to conform to the configuration of the user'arms. Canvas or similar material may be used.

In FIG. 4, the strap 60 is shown disposed on the bar 12 outboard and adjacent the arms 42 and 46. This location is also adjacent arms 22 and 26, as may be seen from FIGS. 1 and 2. The weights 14 and 16 are then disposed outwardly from, or outboard of, the strap 60.

For securing the strap 60 to the bar 12, an appropriate grommet, or the like, is secured to each end of the strap. The grommets receive the respective ends of the bar 12, as shown in FIG. 4. The weights 14 and 16 are then placed on the bar 12. The pairs of collars to hold the weights in place on the bar 12 are not shown in FIG. 4. The strap 60 is also preferably adjustable to conform to the size of the user's arms.

As is well known and understood with respect to weight lifting apparatus, collars are used to hold weights in place. For a straight bar or tube, a pair of collars is used to specifically locate the weights on the bar and keep them from moving. On the apparatus of the present invention, with a pair of arms extending outwardly from the bar with respect to the two frames 20 and 40 secured to the bar, only a single collar is required to hold each of the weights 14 and 16 in place. A pair of collars 13 and 15 and 17 and 19 are shown in phantom respectively disposed against the weights 14 and 16 on the bar 12 in FIG. 2. If desired, depending on the desires of the particular user, the pair of inside collars 13 and 17 may also be omitted. However, such collars are shown in phantom in FIGS. 1 and 2. A pair of collars is shown disposed one on each side of the weight or weights on the bar 12 adjacent the frames 20 and 40 in both FIGS. 1 and 2.

The apparatus 10, as shown in FIGS. 1–5, may be used, primarily by a weight lifter with relatively large forearms, such as the forearm 6 shown in FIG. 5. The difference in angle between the planes of the frames 40 and 20 allows the support frame 20 to rest comfortably on the large forearms of the user, while the hand 8 grasps the leg 44 of the holding frame 40. It will be noted tht only one arm 2 of the weight lifter or user is shown in FIG. 5. However, it will be obvious that both arms of the user will be used for exercising the biceps 4.

For a user with relatively small forearms, a planar arrangement of the weight lifting apparatus 10, such as weight lifting apparatus 110 of FIG. 6, may be used. FIG. 6 comprises a view in partial section of the planar weight lifting apparatus 110. The weight lifting apparatus 110 is substantially identical to the weight lifting apparatus 10, except that the weight lifting apparatus 110 is generally in a single plane. The weight lifting apparatus 110 includes a support frame 120 and a holding frame 140. The support frame 120 includes a pair of arms, including an arm 126, and a leg 124 extending between the arms , with both arms secured to a central bar or tube 112.

The molding frame 140 is also secured to the central bar or tube 112. The holding frame 140 includes a pair of arms, of which arm 146 is shown in FIG. 6, secured to a leg 144. Both arms of the holding frame 140 are secured to the rod or tube 113 in substantially the same manner as discussed above with respect to the apparatus 10. The holding frame and the support frame are one hundred eighty degrees apart, or directly opposite each other, with the primary bar 112 between them.

The support frame 120 is preferably padded with appropriate supports, layers of foam, and a vinyl cover. The elements are disposed over the central bar or tube 112, the outer leg 124, and on top of or outwardly from a pair of support sheets, such as the support sheets 28 and 30 illustrated best in FIGs. 3 with respect to the weight lifting apparatus 10.

It will be noted that a plane passing through the center of the support frame 120 and the bar 112 will also extend through the center of the holding frame 140. As indicated above, this is the primary difference between the apparatus 110 and the apparatus 10. In all other respects, the apparatus is substantially identical.

With the support frame 20 or 120 disposed on the forearms of the user, the muscles of the forearm do not bear the weight as they do with the weight lifting apparatus of the prior art. Accordingly, the muscles of the forearms do not tire before the biceps are fully exercised, as desired by the user. The apparatus of the present invention accordingly allows maximum development of the user's biceps without the accompanying strain to the muscles of the forearm and wrist as with the apparatus of the prior art.

Figure 8:
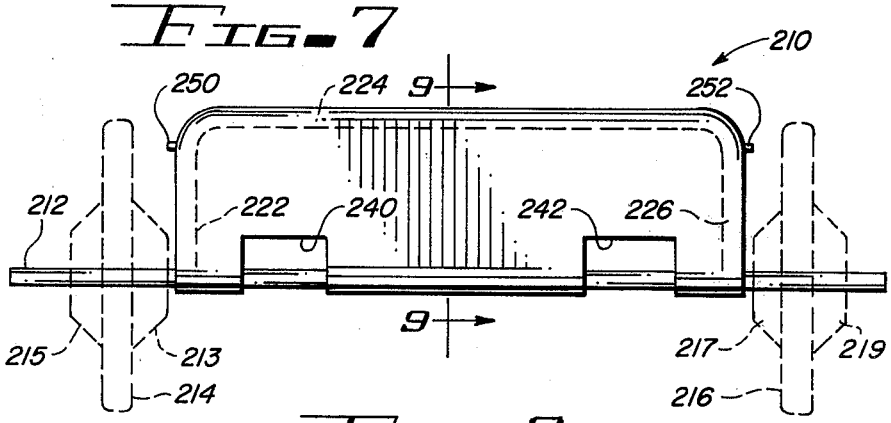
FIG. 8 is a top view of the apparatus of FIG. 7.
Figure 9:
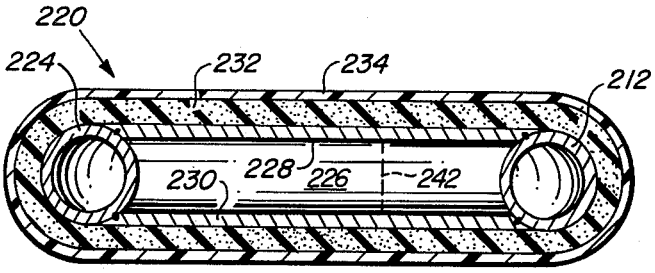
FIG. 9 is a view in partial section of FIG. 8.
Figure 10:
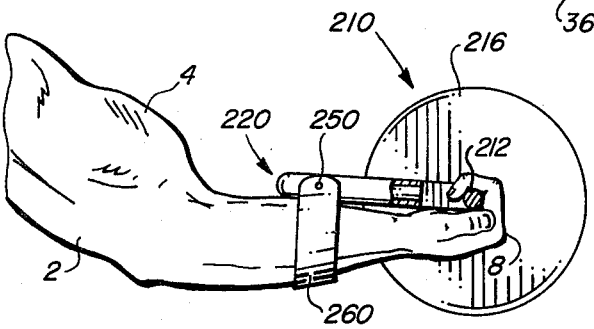
FIG. 10 is a side view in partial section of the apparatus of FIGS. 7–9.

FIG. 7 comprises a perspective view of an alternate embodiment of the present invention as illustrated in FIGS. 1–6. FIG. 8 is a top view of the apparatus of FIG. 7. FIG. 9 is a view in partial section of the apparatus of FIGS. 7 and 8, taken generally along line 9—9 of FIG. 8. FIG. 10 is a side view illustrating the use of the apparatus of FIGS. 7–9. In the following discussion, reference will be made to FIGS. 7–10.

Weight lifting apparatus 210 includes a primary bar 212, which may be a steel rod, or a pipe, tube, or the like. A pair of weights 214 and 216 are shown in dotted line (phantom) secured to the primary rod 212. The weights 214 and 216 are held in place on the rod 212 by collars 215 and 217, also shown in dotted line (phantom). As best shown in FIG. 8, four collars may be used, with a pair of collars on each end of the primary bar, one of which collars is disposed on each side of each weight. Thus, in FIG. 8, a pair of inside collars 213 and 217 are shown, and a pair of outside collars 215 and 219 are also shown, with the pair of weights 214 and 216 disposed respectively between each pair 213, 215, and 217, 219, of collars. Since the weights are shown in FIG. 7 in dotted line, only the collars which would be visible from the viewer's perspective of FIG. 7 are shown.

Secured to the primary bar 212 is a support frame 220. The support frame 220 comprises a pair of parallel arms 222 and 226 secured to the primary bar 212 and extending outwardly therefrom, and a leg 224 extending between the pair of parallel arms. The support frame 220 is covered with padding to protect the forearms of the user of the apparatus. As best shown in FIG. 9, a pair of parallel plates 228 and 230 extends between the primary bar 212 and the outer leg 224. The support plates or sheets 228 and 230 are preferably welded to the bars 212 and 224, and a layer of foam padding 232 extends about the support plates and the bars. A top or outer layer 234 covers the padding or foam layer 232.

It will be noted that, as best shown in FIG. 9, the diameter of the primary bar 212 and the support leg 224 are the same, and both are shown as being comprised of tubing or pipe. Preferably, the support frame 210 comprises a single bar or tube, bent to form an elongated U, with a pair of relatively short arm 222 and 226 spaced apart by a support leg 224.

With the support frame 210 secured to the primary bar 212, and with the absence of a holding bar and a holding frame, a pair of relieved portions comprising hand holds 242 and 240 extend through the support sheets or plates 228 and 230 and through the foam layer 232 and the top layer 234 adjacent the primary bar 212 to enable a user to grasp the bar 212. The hand holds 240 and 242 are spaced apart from each other, and are wide enough to allow the user to conveniently insert his fingers through the hand holds to grasp the rod 212, as shown in FIG. 10. The hand holds 240 and 242 may be elongated, to allow users of different sizes to conveniently place their hands on the bar 212. That is, the hand holds are long enough, in a direction parallel to the bar 21, to accommodate users of various sizes to allow them to keep their arms generally parallel to each other and substantially perpendicular to their bodies.

To insure that the support frame 220 provides its function of supporting the weight of the bar and thus relieve the wrists and forearm muscles of supporting the bar during use of the apparatus 210, a pair of pins 250 and 252 are shown extending outwardly from the arms 222 and 224, respectively. The pins 250 and 252 are used to secure a belt or strap 260 (see FIG. 10) to the apparatus.

The pins 250 and 252 are spaced apart outwardly on the arms 222 and 252, respectively, from the rod 212 a substantial distance, and are relatively close to the outer leg 224, to insure that the apparatus 10 is secured to the forearms of the user. As best shown in FIG. 10, the strap 260 extends beneath the arm 2 of the user, and at about the midpoint of his forearm. The strap 260 serves a dual function, the first of which is to secure the apparatus 210 to the user, and the second of which is to insure that some of the weight of the apparatus 210 is taken off the wrists and forearms of the user during the exercise of the biceps 4 when the apparatus 210 is in use.

As will be readily evident, the efficiency of the apparatus 210 with respect to the exercise of the biceps is substantially decreased below that of the apparatus 210 of FIGS. 1–5 and the apparatus 110 of FIG. 6. The apparatus 10 and the apparatus 110 both include a holding frame which is disposed outwardly from, or spaced apart from the primary bars 12 and 112, respectively, and thus provide a maximum efficiency in relieving the forearms and wrists of the muscular strain imposed upon them by the prior art. The apparatus thus allows the biceps 4 to be exercised to its fullest capacity. However, in the apparatus of FIGS. 7–10, the holding frame is eliminated and only a part of the weight of the apparatus is thus removed from the wrists and forearms because the fingers 8 of the hand of the user are directly engaging the primary bar 212, along the longitudinal axis of which is disposed a substantial amount of the weight of the apparatus, manifested by the weights 214 and 216.

Figure 11:
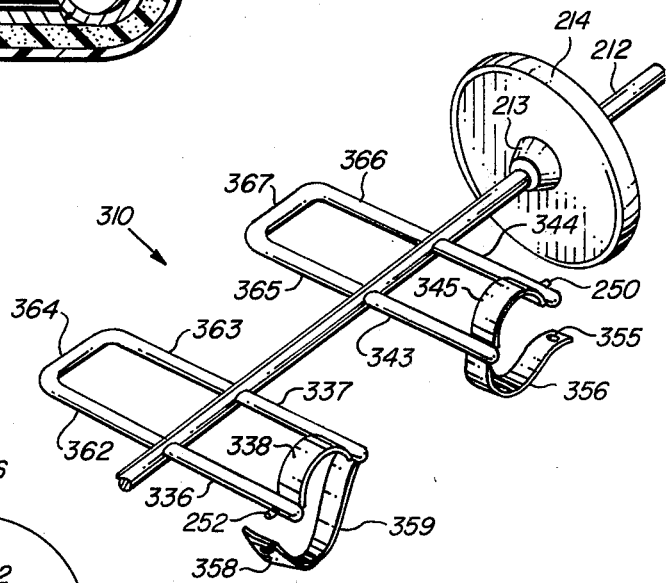
FIG. 11 is a perspective view of another alternate embodiment of the present invention.

FIG. 11 is a perspective view of another alternate embodiment of the apparatus of the present invention, in the general environment of the primary bar 212 of FIGS. 7–10. Weight lifting apparatus 310 of FIG. 11 comprises a "stream-lined" or individualized embodiment in that the structure of a single support frame and a single holding frame are eliminated, and a pair of arm supports and hand holds disposed radially or diametrically with respect to each other and to the primary bar 212 are provided. The support frame and the holding frame comprise a pair of frames of each arm.

Using the primary bar 212, shown with the weight 214 disposed against the collar 213, a pair of support arms 336 and 337 are shown secured to the bar 212 diametrically opposed to a pair of holding arms 362 and 363. The two pair or set are spaced apart from another two pair or set of support and holding arms 343, 344 and 365, 366, respectively. The pairs of support arms, which together comprise a pair of support frames, are generally parallel to each other and they extend radially outwardly from the bar 212 to which they are secured. Similarly, the two pair of holding arms, which together comprise a pair of holding frames, are generally parallel to each other and they extend radially outwardly from the bar 212 to which they are secured. The holding arms are paired with the support arms.

A pin 250 is secured to the arm 344, and a pin 252 is secured to the arm 336. The pins 250 and 252, discussed above in conjunction with FIGS. 7 and 10, are used to secure support straps to the arms. An upper support strap 338 extends between the arms 336 and 337, and an upper support strap 345 extends between the arms 343 and 344. A lower support strap 359 is secured to the arm 337. The strap 359 includes a hole 358 which extends over the pin 252 to secure the strap 359 to the arm 336. A lower holding strap 356, which includes a hole 355, is secured to the arm 344. The hole 355 is used to secure the strap 356 to the pin 250 and the arm 344.

The support straps may include several holes to accommodate forearms of different sizes. Moreover, the lower support straps may be fixed to the support arms, and the upper suppory straps may be removable at one or both ends. If desired, both upper and lower support straps may be removable at at least one end for convenience, or both support straps may be fixed. Another alternative with respect to the support straps may be to use curved and padded fixed supports, or at least one such, instead of or in conjunction with a flexible strap.

The support arms and support straps serve substantially the same purpose as the support frames of the previously discussed embodiments. However, instead of a single, padded support frame, a pair of support frames, each accommodating a forearm, is used. The support straps for the forearms are shown disposed at the outer or distal ends of the support arms. Alternatively, and if desired, each pair of support arms may include a padded frame, as discussed above in conjunction with the embodiments of FIGS. 1–10, with a single support strap for each support frame.

Each pair of holding arms includes a holding leg, with a holding leg 364 extending between and secured to the holding arms 362 and 363, and with a holding leg 367 extending between and secured to the holding arms 365 and 366. Preferably the holding arms and leg pairs comprise each a continuous length of bar or tubing bent into a generally U-shaped configuration and appropriately welded to primary bar 212.

The spacing between each pair of holding arms is such as to accommodate easily and comfortably the hands of users of various sizes. That is, the length of each holding leg 364 and 367 is such as to allow users of different physical sizes to use the apparatus.

While the support arm and holding arm pairs are shown in diametrical relationship to the bar 212 and to each other, a different angular orientation may be used, if desired, for example, an angle alpha, such as illustrated in conjunction with FIG. 3, may be used. Such angular orientation may be advantageous if solid, padded support frames are used. A negative angular orientation may be advantageous for use with support frames, including the straps, shown in FIG. 11. To prevent contact between the primary bar 212 and a user's wrists or forearms.

The weight lifting apparatus discussed herein comprises apparatus designed to allow the biceps muscles to be exercised to their fullest capacity. This is accomplished by relieving the forearm and wrist muscles of the strain imposed upon them by prior art weight lifting apparatus. Since the wrist and forearm muscles tire before the biceps muscles, the apparatus of the present invention allows the biceps to be worked to exhaustion by relieving the weight lifting burden from the forearms and wrists.

While the principles of the invention have been made clear in illustrative embodiments, there will be immediately obvious to those skilled in the art many modifications of tructure, arrangement, proportions, the elements, materials, and components used in the practice of the invention, and otherwise, which are particularly adpated for specific enviroments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Weight lifting apparatus for exercising the biceps muscles, comprising, in combination:

a primary bar for holding weights;

support frame means secured to one side of the primary bar and adapted to rest on the forearms of a user, said support frame means including a first support arm secured directly to and extended from the primary bar, a second support arm secured to and extending from the primary bar and spaced apart from the first support arm, and a support leg secured to and extending between the ends of the first and second support arms for resting on a user's forearms during an exercise; and holding frame means secured to the primary bar and extending a substantiall distnce on the opposite side of the bar for grasping by the hands of a user during an exercise.

2. The apparatus of claim 1 in which the support frame means further includes a support strap secured to the primary bar and adapted to contact the user's arms remote from the support leg.

3. The apparatus of claim 1, in which the holding frame means includes a holding portion spaced apart from the primary bar for grasping by the user.

4. The apparatus of claim 3 in which the holding frame means further includes a first holding arm and a second holding arm spaced apart from each other and secured to the primary bar, and the holding portion spaced apart from the primary bar comprises a holding leg secured to and extending between the first and second holding arms.

5. The apparatus of claim 1 in which the support frame means and the holding frame means are spaced apart from each other and extend generally away from each other and from the primary bar to which they are both secured.

6. The apparatus of claim 1 in which the support frame means further includes padding means for padding the primary bar and the support leg.

7. The apparatus of claim 6 in which the padding means includes padding extending between the primary bar and the support leg.

8. The apparatus of claim 1 in which the first support arm and the second support arm substantially parallel to each other and extend generally away from the primary bar in a first direction, and the holding frame means includes a first holding arm and a second holding arm spaced apart from and substantially parallel to the first holding arm, and both holding arms are secured to the primary bar and extend generally away from the primary bar in a second direction.

9. The apparatus of claim 8 in which the holding frame means further includes a holding leg extending between and secured to the first and second holding arms and adapted to be grasped by the hands of a user.

10. The apparatus of claim 9 in which the support leg, the primary bar, and the holding leg are substantially parallel to each other.

11. The apparatus of claim 8 in which the first and second directions in which the support arms and the holding arms extend are substantially one hundred eighty degrees apart.

12. The apparatus of claim 8 in which the first and second directions in which the support arms and the holding arms extend are less than one hundred eighty degrees apart.

* * * * *